US009868926B2

(12) United States Patent
Wiedemann et al.

(10) Patent No.: US 9,868,926 B2
(45) **Date of Patent: *Jan. 16, 2018**

(54) DOSAGE ELEMENT AND A METHOD OF MANUFACTURING A DOSAGE ELEMENT

(71) Applicant: Reckitt Benckiser N.V., Hoofddorp (NL)

(72) Inventors: Ralf Wiedemann, Venice (IT); Pavlinka Roy, Ludwigshafen (DE); Frederic Moreux, Barcelona (ES)

(73) Assignee: RECKITT BENCKISER FINISH B.V., Hoofddorp (NL)

( * ) Notice: Subject to any disclaimer, the term of this patent is extended or adjusted under 35 U.S.C. 154(b) by 0 days.

This patent is subject to a terminal disclaimer.

(21) Appl. No.: 14/263,415

(22) Filed: Apr. 28, 2014

(65) Prior Publication Data

US 2014/0235522 A1 Aug. 21, 2014

Related U.S. Application Data

(62) Division of application No. 12/523,566, filed as application No. PCT/GB2008/000158 on Jan. 17, 2008, now Pat. No. 8,754,025.

(30) Foreign Application Priority Data

Jan. 18, 2007 (GB) ..... 0700925.1

(51) Int. Cl.
*C11D 17/04* (2006.01)
*C11D 11/00* (2006.01)
(Continued)

(52) U.S. Cl.
CPC ..... *C11D 17/0039* (2013.01); *B65B 9/042* (2013.01); *C11D 17/042* (2013.01); *C11D 17/045* (2013.01)

(58) Field of Classification Search
None
See application file for complete search history.

(56) References Cited

U.S. PATENT DOCUMENTS 8,669,219 B2 * 3/2014 Wiedemann ..... B65D 65/46 510/293
8,754,025 B2 * 6/2014 Wiedemann ..... C11D 17/041 134/25.2
(Continued)

FOREIGN PATENT DOCUMENTS

DE 1287502 B 1/1969
DE 1411993 A1 2/1969
(Continued)

*Primary Examiner* — Lorna Douyon
(74) *Attorney, Agent, or Firm* — Troutman Sanders LLP; Ryan Schneider; Chris Davis

(57) ABSTRACT

A dosage element of a type to be consumed in ware washing comprises first (10) and second joined parts (20). The first part (10) comprises a substrate carrying a substance, but preferably carrying a plurality of mutually separated substances A, C. Opposed, second, part (20) comprises a substrate carrying one or more substances B. The first part (10) is joined to the second part (20) so as to form a closed receptacle enclosing the substances in a meshing or interdigitating manner. This arrangement has benefits in manufacturing and in mechanical properties.

10 Claims, 1 Drawing Sheet

(51) Int. Cl.
*C11D 17/00* (2006.01)
*B65B 9/04* (2006.01)

(56) References Cited

U.S. PATENT DOCUMENTS

| | | | | |
|---|---|---|---|---|
| 2002/0169092 | A1 | 11/2002 | Catlin et al. | |
| 2003/0137652 | A1 | 7/2003 | Mori | |
| 2004/0029764 | A1* | 2/2004 | Weber | C11D 17/042 510/446 |
| 2008/0248989 | A1 | 10/2008 | Holderbaum | |

FOREIGN PATENT DOCUMENTS

| | | | |
|---|---|---|---|
| DE | 102006031337 | A1 | 1/2007 |
| EP | 1506925 | A1 | 2/2005 |
| EP | 1679362 | A1 | 7/2006 |
| GB | 2361686 | A | 10/2001 |
| GB | 2374580 | A | 10/2002 |
| GB | 2374581 | A | 10/2002 |
| GB | 2390840 | A | 1/2004 |
| WO | 005504 | A1 | 9/2000 |
| WO | 0185898 | A1 | 11/2001 |
| WO | 0208380 | A1 | 1/2002 |
| WO | 0242408 | A2 | 5/2002 |
| WO | 2004014753 | A1 | 8/2003 |
| WO | 03072693 | A | 9/2003 |
| WO | 03072694 | A1 | 9/2003 |
| WO | 2004103849 | A1 | 12/2004 |
| WO | 2005121302 | A1 | 12/2005 |
| WO | 2005123511 | A1 | 12/2005 |
| WO | 2007116357 | A2 | 10/2007 |

* cited by examiner

DOSAGE ELEMENT AND A METHOD OF MANUFACTURING A DOSAGE ELEMENT

This application is a divisional of U.S. application Ser. No. 12/523,566 filed Dec. 15, 2009, now U.S. Pat. No. 8,754,025, which is a 371 application of PCT/GB2008/000158 filed Jan. 17, 2008, which is claims priority to GB application 0700925.1 filed Jan. 18, 2007.

The invention relates to a dosage element for a ware washing machine and to a method of manufacture thereof.

Ware washing machines, such as automatic clothes washing and dishwashing machines, typically utilise detergents and other additives in solid, liquid or powder form. These substances are either administered directly into the machine, or dispensed via a tray or a dedicated compartment system to be added to the washing area at the start of, or during, a washing cycle.

Often, the required detergents/additives are administered as a compound tablet comprising a plurality of active ingredients. These may be kept separate for reasons of incompatibility. Alternatively or additionally they may be kept separate so that they may be activated at different points during a washing cycle or rinsing cycle. This activation at a particular point may be achieved by including time and/or temperature dependent released elements within the composition. One technique involves the coating or encasing of individual active components of the compound tablet within a water soluble polymer or gel of given properties/thickness to provide a time delayed and/or temperature dependent exposure to the component within so that it is exposed to the wash liquor within the ware washing machine at the desired point in a cycle.

In compound dosage elements of the type described above, individual active components may be in any state such as a solid, particulate or liquid form.

With the need to accommodate perhaps three or four active components within a single convenient dosage element, comes the complication of isolating each component from its neighbour and providing the dosage form within an overall compact package. These issues lead to complications within the manufacturing process and an increase in the costs of production. Accordingly, it is one aim of preferred embodiments of the present invention to provide a relatively simple dosage element formation and uncomplicated method of construction.

Consumers are becoming increasingly reluctant to handle detergent compositions directly as there are perceived health/hygiene issues to doing so. With this in mind, it is desired to provide a barrier between the hand of the consumer and the ingredients of the dosage element and to reduce the risks of inadvertent exposure of the consumer to active ingredients of the dosage elements.

According to a first aspect of the invention, there is provided a dosage element to be consumed in use in a ware washing machine, the dosage element comprising first and second joined parts, wherein the first part comprises a substrate carrying one or more substances and wherein the second part comprises a substrate carrying one or more substances and wherein the first part is joined to the second part in peripheral areas thereof so as to form a closed receptacle enclosing said substances within it.

In the present invention the dosage element is suitably consumed in a washing cycle, in the sense that at the end of cycle no part of it has to be removed from the machine; indeed, preferably, no part of it can be discerned, within the machine.

Preferably the one or more substances of the first part is/are offset with respect to said one or more substances of the second part. Preferably they are engaged together in a side by side arrangement, preferably in a closely nested arrangement.

Preferably the substrate of the first part carries a plurality of mutually separated substances arranged in side by side relation. In such an embodiment the first and second parts are preferably arranged such that substances carried by the first substrate and the substance or substances carried by the second substrate mesh or interdigitate within the receptacle. Preferably the parts which mesh or interdigitate do so in a close or snug-fitting manner but not so close that the operation of bringing them together is compromised (for example liable to cause damage of the substances, or so as to make their bringing together more difficult). In general it may be said that the footprint of a substance fitting between two other substances is substantially the same as or slightly smaller than the space available before assembly.

In one variation the first part may comprise a plurality of elements (or cores) of said substances adhered to the respective substrate in spaced apart relation and the second part may comprise one or more elements (or cores) adhered to the respective substrate.

In a second variation the first part comprises a plurality of compartments supported by its respective substrate, each compartment containing one of said plurality of substances. Similarly, the second part may comprise one or more compartments supported by its respective substrate and the or each compartment thereof contains a further substance.

Preferably, each of the first and second parts comprise first and second elements (or cores), wherein the respective second elements each comprise a pocket having one or more compartments for receiving a substance therein and wherein the respective first elements close the pocket(s) formed by the second elements, such that each substance is enclosed within a respective pocket. Here, the first parts and the second parts may be flexible in isolation, but when joined to one another in peripheral regions combine to form a stable dosage element.

Suitably, the first and second parts are brought together during a manufacturing step, and the substance or substances of one part engage the substance or substances of the other part such as to substantially fill spaces adjacent said substances. Preferably the end result is a dosage element in which each part supports the other part so as to reduce the likelihood of damage to the respective substances, for example during manufacturing, packing, handling or transportation.

The substances referred to herein may suitably comprise a liquid, or a flowable solid such as a powder, or a flowable or pumpable gel.

Preferably the wall materials, including the substrates and the compartments where this construction is used, are of water-soluble polymeric material(s). The materials thereof may be the same or different. In many embodiments they will be of the same grade and/or thickness but the invention does offer the prospect of supplying a dosage form having differential rates of release of different substances, arising from selection of different wall materials. Thus the walls of the first part could be selected to be fast to dissolve and the walls of the second part could be selected to be slower to dissolve. The second part might usefully then be the vehicle for delivery of, for example, a rinse aid.

Water-soluble herein includes water-dispersible.

Preferably, the first part and second part are made by thermoforming a water-soluble sheet or film, but could be formed by injection moulding.

Preferably each of the first and second parts are of a material which is flexible, in the sense that when subjected to a deflecting force it does not generate a force acting to restore it to its previous position or shape (as would a "flexible" plastics ruler). Preferably the lid-forming part is a film (by which we mean to include herein a foil).

Each of the first and second parts may have a peripheral region, and the peripheral regions are arranged face-to-face when the parts are brought together for closing of the receptacle. These regions are suitably the means by which the first and second parts are joined. They are suitably sealed to each other face-to-face, in the finished dosage element. Thus, the dosage element suitably has a peripheral skirt, which represents the sealing zone.

The two parts may be sealed together by means of an adhesive, preferably an aqueous liquid, preferably a PVOH solution or water. The adhesive may be applied to one of both peripheral regions. Alternatively they may be sealed together by heat sealing. Other methods of sealing include infra-red, radio frequency, ultrasonic, laser, solvent (such as water), vibration and spin welding. If heat sealing is used, a suitable sealing temperature is for example 125° C. A suitable sealing pressure is readily selected by the person skilled in the art.

Preferably, the walls of, or within, the dosage element are of film or sheet material having a thickness of between 30 and 600 μm. When thermoforming is used, the thickness is preferably in the range 30-250 μm, preferably 40-200 μm, preferably 50-150 μm. When injection moulding is used, the thickness is preferably in the range 200-600 μm, preferably 240-600 μm preferably 250-400 μm.

Suitable water-soluble polymeric materials for use in this invention are such that discs of 100 μm thickness and 30 mm diameter dissolve in 5 liters of water maintained at 50° C., under gentle stirring, in less than 30 minutes.

A water-soluble polymeric material for use herein may suitably be selected from the group comprising polyvinyl alcohols, polyvinyl alcohol copolymers, partially hydrolyzed polyvinyl acetates, cellulose derivatives (such as alkylcelluloses, hydroxyalkylcelluloses, salts, ethers and esters of alkylcelluloses and hydroxyalkylcelluloses, for example, hydroxypropylcellulose, hydroxypropylmethyl-cellulose and sodium carboxymethylcellulose); polyglycolides, polyglycolic acids, polylactides, polylactic acids; polyvinyl pyrrolidines, polyacrylic acids or salts or esters thereof, polymaleic acids or salts or esters thereof, dextrins, maltodextrins, polyacrylamides, acrylic acid/maleic anhydride copolymers, including copolymers (which includes terpolymers), and blends. Optionally fillers, plasticisers and process aids may also be comprised in the formulation of a water-soluble polymeric material for use herein.

Preferred polymeric materials for are selected from the group comprising polyvinyl alcohols, polyvinyl alcohol copolymers, and partially hydrolyzed polyvinyl acetates. An especially preferred water-soluble polymeric material comprises a poly(vinyl alcohol).

Preferably the dosage element is not of squared-off, cuboid appearance and/or is preferably not rigid. Preferably is not box-like, in look or feel. Preferably it is of somewhat rounded, preferably pillow-like appearance, and/or is of compliant or "squashy" feel.

A preferred dosage form of the invention is a laundry washing tablet or, most preferably, a dishwashing tablet. We use the term tablet here to denote a body which can be handled by a consumer as a discrete element, for example as a unit dose. Preferably the first and second substances comprise laundry detergent compositions, or, especially, dishwashing detergent compositions.

Preferred components of a dishwashing tablet are as follows:

Bleaching Compounds

Any type of bleaching compound conventionally used in detergent compositions may be used according to the present invention. Preferably the bleaching compound is selected from inorganic peroxides or organic peracids, derivatives thereof (including their salts) and mixtures thereof. Especially preferred inorganic peroxides are percarbonates, perborates and persulphates with their sodium and potassium salts being most preferred. Sodium percarbonate and sodium perborate are most preferred, especially sodium percarbonate.

Organic peracids include all organic peracids traditionally used as bleaches, including, for example, perbenzoic acid and peroxycarboxylic acids such as mono- or diperoxyphthalic acid, 2-octyldiperoxysuccinic acid, diperoxydodecanedicarboxylic acid, diperoxy-azelaic acid and imidoperoxycarboxylic acid and, optionally, the salts thereof. Especially preferred is phthalimidoperhexanoic acid (PAP).

Desirably the bleaching compound is present in the compositions in an amount of from 1 to 60 wt %, especially 5 to 55 wt %, most preferably 10 to 50% wt, such as 10 to 20% wt. When the compositions of the invention comprise two or more distinct regions, the amount of bleaching compound typically present in each can be chosen as desired although the total amount of the bleaching compound will typically be within the amounts stated hereinabove.

Builders

The detergent compositions may also comprise conventional amounts of detergent builders which may be either phosphorous based or non-phosphorous based, or even a combination of both types. Suitable builders are well known in the art.

If phosphorous builders are to be used then it is preferred that mono-phosphates, di-phosphates, tri-polyphosphates or oligomeric-polyphosphates are used. The alkali metal salts of these compounds are preferred, in particular the sodium salts. An especially preferred builder is sodium tripolyphosphate (STPP).

The non-phosphorous based builder may be organic molecules with carboxylic group(s), amino acid based compound or a succinate based compound. The term 'succinate based compound' and 'succinic acid-based compound' are used interchangeably herein.

Builder compounds which are organic molecules containing carboxylic groups include citric acid, fumaric acid, tartaric acid, maleic acid, lactic acid and salts thereof. In particular the alkali or alkaline earth metal salts of these organic compounds may be used, and especially the sodium salts. An especially preferred builder is sodium citrate.

Preferred examples of amino acid based compounds according to the invention are MGDA (methyl-glycine-diacetic acid, and salts and derivatives thereof) and GLDA (glutamic-N,N-diacetic acid and salts and derivatives thereof). GLDA (salts and derivatives thereof) is especially preferred according to the invention, with the tetrasodium salt thereof being especially preferred. Other suitable builders are described in U.S. Pat. No. 6,426,229 which is incorporated by reference herein. Particular suitable builders include; for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl) aspartic acid (SMAS), N-(2-sulfoethyl)aspartic acid (SEAS), N-(2-sulfomethyl)glutamic acid (SMGL), N-(2-sulfoethyl)glutamic acid (SEGL), N-methyliminodiacetic acid (MIDA), α-alanine-N,N-diacetic acid (α-ALDA), β-alanine-N,N-diacetic acid (β-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts or ammonium salts thereof.

Further preferred succinate compounds are described in U.S. Pat. No. 5,977,053 and have the formula;

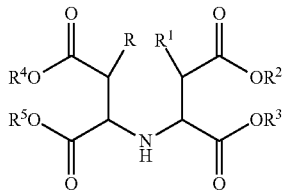

in which R, $R^1$, independently of one another, denote H or OH, $R^2$, $R^3$, $R^4$, $R^5$, independently of one another, denote a cation, hydrogen, alkali metal ions and ammonium ions, ammonium ions having the general formula $R^6R^7R^8R^9N+$ and $R^6$, $R^7$, $R^8$, $R^9$, independently of one another, denoting hydrogen, alkyl radicals having 1 to 12 C atoms or hydroxyl-substituted alkyl radicals having 2 to 3 C atoms. A preferred example is tetrasodium imminosuccinate.

Preferably the total amount of builder present in the compositions of the invention is an amount of at least 5 wt %, preferably at least 10 wt %, more preferably at least 20 wt %, and most preferably at least 25 wt %, preferably in an amount of up to 70 wt %, preferably up to 65 wt %, more preferably up to 60 wt %, and most preferably up to 35 wt %. The actual amount used will depend upon the nature of the builder used.

The detergent compositions of the invention may further comprise a secondary builder (or cobuilder). Preferred secondary builders include homopolymers and copolymers of polycarboxylic acids and their partially or completely neutralized salts, monomeric polycarboxylic acids and hydroxycarboxylic acids and their salts, phosphates and phosphonates, and mixtures of such substances. Preferred salts of the abovementioned compounds are the ammonium and/or alkali metal salts, i.e. the lithium, sodium, and potassium salts, and particularly preferred salts is the sodium salts.

Secondary builders which are organic are preferred.

Suitable polycarboxylic acids are acyclic, alicyclic, heterocyclic and aromatic carboxylic acids, in which case they contain at least two carboxyl groups which are in each case separated from one another by, preferably, no more than two carbon atoms.

Polycarboxylates which comprise two carboxyl groups include, for example, water-soluble salts of, malonic acid, (ethylenedioxy)diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid.

Another suitable polycarboxylic acid is the homopolymer of acrylic acid. Other suitable builders are disclosed in WO 95/01416, to the contents of which express reference is hereby made.

Surfactants

The detergent compositions of the invention may contain surface active agents, for example, anionic, cationic, amphoteric or zwitterionic surface active agents or mixtures thereof. Many such surfactants are described in Kirk Othmer's Encyclopedia of Chemical Technology, 3rd Ed., Vol. 22, pp. 360-379, "Surfactants and Detersive Systems", incorporated by reference herein. In general, bleach-stable surfactants are preferred.

A preferred class of nonionic surfactants is ethoxylated non-ionic surfactants prepared by the reaction of a monohydroxy alkanol or alkylphenol with 6 to 20 carbon atoms. Preferably the surfactants have at least 12 moles particularly preferred at least 16 moles, and still more preferred at least 20 moles of ethylene oxide per mole of alcohol or alkylphenol.

Particularly preferred non-ionic surfactants are the nonionics from a linear chain fatty alcohol with 16-20 carbon atoms and at least 12 moles particularly preferred at least 16 and still more preferred at least 20 moles of ethylene oxide per mole of alcohol.

According to one embodiment of the invention, the nonionic surfactants additionally may comprise propylene oxide units in the molecule. Preferably these PO units constitute up to 25% by weight, preferably up to 20% by weight and still more preferably up to 15% by weight of the overall molecular weight of the non-ionic surfactant.

Surfactants which are ethoxylated mono-hydroxy alkanols or alkylphenols, which additionally comprises polyoxyethylene-polyoxypropylene block copolymer units may be used. The alcohol or alkylphenol portion of such surfactants constitutes more than 30%, preferably more than 50%, more preferably more than 70% by weight of the overall molecular weight of the non-ionic surfactant.

Another class of suitable non-ionic surfactants includes reverse block copolymers of polyoxyethylene and polyoxypropylene and block copolymers of polyoxyethylene and polyoxypropylene initiated with trimethylolpropane.

Another preferred class of nonionic surfactant can be described by the formula:

$$R^1O[CH_2CH(CH_3)O]_x[CH_2CH_2O]_y[CH_2CH(OH)R^2]$$

where $R^1$ represents a linear or branched chain aliphatic hydrocarbon group with 4-18 carbon atoms or mixtures thereof, $R^2$ represents a linear or branched chain aliphatic hydrocarbon rest with 2-26 carbon atoms or mixtures thereof, x is a value between 0.5 and 1.5 and y is a value of at least 15.

Another group of preferred nonionic surfactants are the end-capped polyoxyalkylated non-ionics of formula:

$$R^1O[CH_2CH(R^3)O]_x[CH_2]_kCH(OH)[CH_2]_jOR^2$$

where $R^1$ and $R^2$ represent linear or branched chain, saturated or unsaturated, aliphatic or aromatic hydrocarbon groups with 1-30 carbon atoms, $R^3$ represents a hydrogen atom or a methyl, ethyl, n-propyl, iso-propyl, n-butyl, 2-butyl or 2-methyl-2-butyl group, x is a value between 1 and 30 and, k and j are values between 1 and 12, preferably between 1 and 5. When the value of x is >2 each $R^3$ in the formula above can be different. $R^1$ and $R^2$ are preferably linear or branched chain, saturated or unsaturated, aliphatic or aromatic hydrocarbon groups with 6-22 carbon atoms, where group with 8 to 18 carbon atoms are particularly preferred.

For the group $R^3H$, methyl or ethyl are particularly preferred. Particularly preferred values for x are comprised between 1 and 20, preferably between 6 and 15.

As described above, in case x>2, each $R^3$ in the formula can be different. For instance, when x=3, the group $R^3$ could be chosen to build ethylene oxide ($R^3$=H) or propylene oxide ($R^3$=methyl) units which can be used in every single order for instance (PO)(EO)(EO), (EO)(PO)(EO), (EO)(EO)(PO), (EO)(EO)(EO), (PO)(EO)(PO), (PO)(PO)(EO) and (PO)(PO)(PO). The value 3 for x is only an example and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R^1O[CH_2CH(R^3)O]_xCH_2CH(OH)CH_2OR^2$$

The use of mixtures of different nonionic surfactants is suitable in the context of the present invention, for instance, mixtures of alkoxylated alcohols and hydroxy group containing alkoxylated alcohols.

Other suitable surfactants are disclosed in WO 95/01416, to the contents of which express reference is hereby made.

Preferably the non-ionic surfactants are present in the compositions of the invention in an amount of from 0.1% wt to 5% wt, more preferably 0.5% wt to 3% wt, such as 0.5 to 3% wt.

The surfactants are typically included in amounts of up to 15% wt, preferably of from 0.5% wt to 10% wt, such as 1% wt to 5% wt in total.

Anti-Foam Agents

The detergent composition according to the invention may comprise one or more foam control agents. Suitable foam control agents for this purpose are all those conventionally used in this field, such as, for example, silicones and paraffin oil. If present, the foam control agents are preferably present in the composition in amounts of 5% by weight or less of the total weight of the composition.

Anti-Corrosion Agents

It is known to include a source of multivalent ions in cleaning compositions, and in particular in automatic dishwashing compositions, for technical and/or performance reasons. For example, multivalent ions and especially zinc and/or manganese ions have been included for their ability to inhibit corrosion on metal and/or glass. Bismuth ions may also have benefits when included in such compositions.

For example, organic and inorganic redox-active substances which are known as suitable for use as silver/copper corrosion inhibitors are mentioned in WO 94/26860 and WO 94/26859. Suitable inorganic redox-active substances are, for example, metal salts and/or metal complexes chosen from the group consisting of zinc, manganese, titanium, zirconium, hafnium, vanadium, cobalt and cerium salts and/or complexes, the metals being in one of the oxidation states II, III, IV, V or VI. Particularly suitable metal salts and/or metal complexes are chosen from the group consisting of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$ and $Ce(NO_3)_3$. Zinc salts are specially preferred corrosion inhibitors.

Therefore, an especially preferred optional ingredient according to the present invention is a source of multivalent ions such as those mentioned in the immediately preceding paragraph and in particular zinc, bismuth and/or manganese ions. In particular a source of zinc ions is preferred. Any suitable source of multivalent ions may be used, with the source preferably being chosen from sulphates, carbonates, acetates, gluconates and metal-protein compounds and those mentioned in the immediately preceding paragraph.

Any conventional amount of multivalent ions/multivalent ions source may be included in the compositions of the invention. However, it is preferred that the multivalent ions are present in an amount of from 0.01% wt to 5% wt, preferably 0.1% wt to 3% wt, such as 0.5% wt to 2.5% wt. The amount of multivalent ion source in the compositions of the invention will thus be correspondingly higher.

The detergent composition may also comprise a silver/copper corrosion inhibitor in conventional amounts. This term encompasses agents that are intended to prevent or reduce the tarnishing of non-ferrous metals, in particular of silver and copper. Preferred silver/copper corrosion inhibitors are benzotriazole or bis-benzotriazole and substituted derivatives thereof. Other suitable agents are organic and/or inorganic redox-active substances and paraffin oil. Benzotriazole derivatives are those compounds in which the available substitution sites on the aromatic ring are partially or completely substituted. Suitable substituents are linear or branch-chain $C_{1-20}$ alkyl groups and hydroxyl, thio, phenyl or halogen such as fluorine, chlorine, bromine and iodine. A preferred substituted benzotriazole is tolyltriazole.

Performance Polymers

Polymers intended to improve the cleaning performance of the detergent compositions may also be included therein. For example sulphonated polymers may be used. Preferred examples include copolymers of $CH_2{=}CR^1{-}CR^2R^3{-}O{-}C_4H_3R^4{-}SO_3X$ wherein $R^1$, $R^2$, $R^3$, $R^4$ are independently 1 to 6 carbon alkyl or hydrogen, and X is hydrogen or alkali with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Other suitable sulfonated monomers for incorporation in sulfonated (co)polymers are 2-acrylamido-2-methyl-1-propanesulfonic acid, 2-methacrylamido-2-methyl-1-propanesulfonic acid, 3-methacrylamido-2-hydroxy-propanesulfonic acid, allysulfonic acid, methallysulfonic acid, 2-hydroxy-3-(2-propenyloxy)propanesulfonic acid, 2-methyl-2-propenen-1-sulfonic acid, styrenesulfonic acid, vinylsulfonic acid, 3-sulfopropyl acrylate, 3-sulfopropylmethacrylate, sulfomethylacrylamide, sulfomethylmethacrylamide and water soluble salts thereof. Suitable sulfonated polymers are also described in U.S. Pat. No. 5,308,532 and in WO 2005/090541.

When a sulfonated polymer is present, it is preferably present in the composition in an amount of at least 0.1 wt %, preferably at least 0.5 wt %, more preferably at least 1 wt %, and most preferably at least 3 wt %, up to 40 wt %, preferably up to 25 wt %, more preferably up to 15 wt %, and most preferably up to 10 wt %.

Enzymes

The detergent composition of the invention may comprise one or more enzymes. It is preferred that the enzyme is selected from protease, lipase, amylase, cellulase and peroxidase enzymes. Such enzymes are commercially available and sold, for example, under the registered trade marks Esperase, Alcalase and Savinase by Nova Industries A/S and Maxatase by International Biosynthetics, Inc. It is most preferred that protease enzymes are included in the compositions according to the invention; such enzymes are effective for example in dishwashing detergent compositions.

Desirably enzyme(s) is/are present in the composition in an amount of from 0.01 to 3 wt %, especially 0.1 to 2.5 wt %, such as 0.2 to 2 wt %.

Buffering Systems

The detergent composition according to the invention may comprise a buffering system to maintain the pH of the composition at a desired pH on dissolution and this may comprise a source of acidity or a source of alkalinity as necessary.

A source of acidity may suitably be any components which are acidic; for example polycarboxylic acids. Citric acid is especially preferred. Salts of these acids may also be used. A source of alkalinity may suitably be any suitable compound which is basic; for example any salt of a strong base and a weak acid such as soda. However additional acids or bases may be present. In the case of alkaline compositions silicates, phosphates or hydrogen phosphates may suitably be used. Preferred silicates are sodium silicates such as sodium disilicate, sodium metasilicate and crystalline phyllosilicates.

Perfume, Colours, Preservatives

The detergent compositions of the invention may also comprise minor, conventional amounts of perfumes, preservatives and/or colourants. Such ingredients are typically present in amounts of up to 2% wt.

Contrasting Parts

Preferred dosage forms have first and second parts which contrast with each other. They may contrast in the chemical nature of their components. The components may have different functions in a ware washing environment. They may be incompatible with each other. For example one component may interact adversely with another component to cause instability in storage or to reduce effective cleaning action, and such components may be segregated, one in the first part and one in the second part.

Alternatively or additionally the first and second parts may be arranged to release their components at different times in the washing process. This may be achieved by use of different coverings or skins for the components; for example by use of different wall materials for the first and second parts, with different rates of dissolution in the wash water and/or by use of walls of different thicknesses for the first and second parts.

Alternatively or additionally it may facilitate manufacture to separate certain components, and thereby create a contrast between the first and second parts.

Alternatively or additionally the first and second parts may contrast in their properties for aesthetic reasons.

The following are examples of contrasting first and second parts:

an enzyme in one part and a bleach in another part;

a corrosion inhibitor in one part and a bleach in another part;

a corrosion inhibitor in one part and an enzyme in another part;

an acid or a hydrolysable agent in one part and an alkalinity agent in another part;

a solid (including a powder or a gel) in one part and a liquid in another part;

a solid (including a powder or a gel) in one part and another solid (including a powder or a gel) in another part, to be kept apart, whether for chemical/functional reasons or aesthetic reasons;

a liquid in one part and another liquid in another part, to be kept apart, whether for chemical/functional reasons or aesthetic reasons;

a pre-wash formulation (including a ware washing machine cleaner, for example machine sanitizer and/or descaler), in one part and a main wash formulation in another part;

a main wash formulation in one part and a rinse aid formulation in another part.

It is an important advantage of this invention that the dosage element is stable and relatively stress-free and stress-resistant. The spatial relationship of the substances means that they provide mutual support, and resistance to bending. The dosage element is preferably made with spaces between the substances. This is convenient for manufacture, and the spaces collapse during assembly, leading to space efficiency and mutual support. Potential weak spots (which may be at corners or radiused portions of compartment walls) are supported against rupture, so reducing damage in handling or transit.

Preferably the weight of the dosage element is up to 34 g, preferably up to 30 g.

Preferably the weight of the dosage element is at least 4 g, preferably at least 10 g, preferably at least 14 g.

Preferably the weight of the first part fully loaded with its substance(s) is in the range 40-96% of the weight of the dosage element, preferably 60-94%, preferably 80-92% and the weight of the second part fully loaded with its substance(s) is the balance of the weight of the dosage element, thus being in the range 4-60% of the weight of the dosage element, preferably 5-40%, preferably 8-20%.

Preferably the ratio by weight of the said substances contained in the dosage element to the total water-soluble polymeric material(s) (the sum thereof making up the total weight of the dosage element) is in the range 10:1 to 100:1, preferably 16:1 to 60:1, preferably 24:1 to 40:1.

Preferably the weight of the total water-soluble polymeric material(s) is at least 0.1 g, preferably at least 0.2 g, preferably at least 0.3 g.

Preferably the weight of the total water-soluble polymeric material(s) is up to 2 g, preferably up to 1 g, preferably up to 0.7 g.

According to a second aspect of the invention, there is provided a method of manufacturing a dosage element which is to be consumed in use in a ware washing machine, the method comprising:

(a) forming a first part into a substrate carrying one or more substances and;

(b) forming a second part into a substrate carrying one or more substances; and (c) joining the first part to the second part in peripheral areas thereof so as to form a closed receptacle enclosing said substances within it.

Preferably, step (a) comprises the sub-steps of: (a1) forming a pocket with one or more chambers; (a2) introducing said substance(s) to chamber(s) of the pocket; and (a3) closing the chamber(s) with a lid, which may be a sheet or film.

Step (a1) may comprise forming a sheet or film within a cavity of a mould; preferably by thermoforming.

Suitably, in step (a3) the lid is applied when the substrate is still in the mould.

Preferably the thickness of the lid is in the range of 60 to 75 μm.

Preferably, in step (a3) the or each chamber is closed by sealing the chamber(s) with the lid.

Sealing of the lid to the chamber(s) may be as was described above for joining the first and second parts.

In a variation to the method, step (a) comprises adhering individual element(s) of said substance(s) to the substrate.

Step (b) may comprise the sub-steps of: (b1) forming a pocket having one or more chambers; (b2) introducing a substance to the or each chamber of the pocket; and (b3) closing the or each chamber with a lid. Preferred features of step (b) are the same as defined above as preferred features of step (a).

Preferably the substrate of the first part comprises a plurality of mutually separated substances arranged in side by side relation, and in step (c) the first and second parts are arranged such that substances carried by the first substrate and the substance or substances carried by the second substrate mesh or interdigitate.

Preferably, a mould comprises a plurality of cavities for forming a plurality of first parts at one time.

Preferably, a second mould comprises a plurality of cavities for forming a plurality of second parts at one time.

The method preferably comprises the step of separating the completed dosage elements into individual dosage elements or into groups of dosage elements, for example 4-16 in number, which are packaged in such groups and are intended to be separated into individual dosage elements by the user.

After the steps described above the dosage elements may be packaged.

Preferably the steps described above define the manufacturing method fully; that is, there is preferably no further substantive manufacturing step. In particular there is for example preferably no step of setting the dosage elements face-to-face, for example by folding.

The dosage element of the first aspect need not be made by the method of the second aspect. Nevertheless preferred aspects defined with reference to the second aspect may (unless not possible) be regarded as preferred aspects of the first aspect whether or not made by the method of the second aspect; and vice-versa.

However, the dosage element of the first aspect is preferably made by the method of the second aspect. In a third aspect of the invention there is provided a dosage element made by a method of the second aspect.

According to a fourth aspect there is provided a method of ware washing in a machine, preferably a method of washing kitchenware in a dishwashing machine, using a dosage element of the first aspect, or a dosage element of the third aspect. In this method the dosage element is wholly consumed in one wash cycle.

For a better understanding of the invention, and to show how embodiments of the same may be carried into effect, reference will now be made, by way of example, to the accompanying diagrammatic drawings in which.

Referring to FIGS. 1 to 6 there will now be described a dosage element in accordance with an embodiment of the invention and a method of manufacture thereof.

Figure 1:
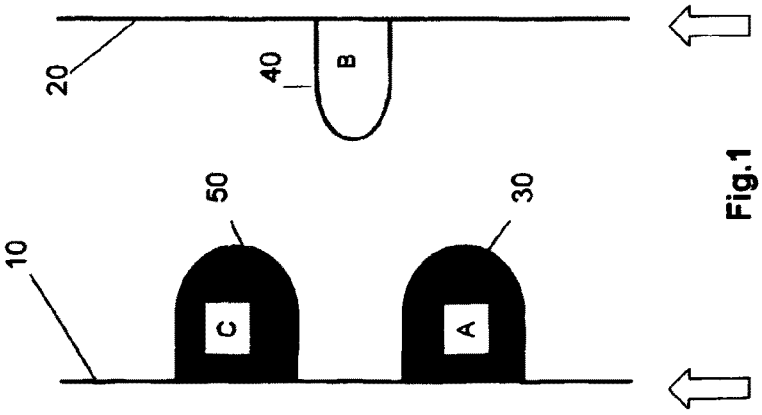
FIG. 1 is a schematic diagram showing a side view of first and second parts for a multi-compartment dosage element. This diagram shows the parts separated and opposed.

In FIG. 1 there is shown a two-part dosage element comprising a first part 10 which is a substrate carrying a pair of substances A and C, and a second part 20 comprising a similar substrate carrying a single substance B. Substance A is shown as being carried within a closed compartment 30, whilst substance B is shown within a closed compartment 40 and substance C is shown within a closed compartment 50. All wall materials are water-soluble polyvinyl alcohol (PVOH).

Whilst only the parts required for a single dosage element to be formed are shown in FIG. 1, it will be appreciated that, in fact, the first and second parts 10, 20 form parts of larger sheets which during manufacture are disposed in parallel relation to one another and may be in motion as indicated by the arrows shown in the figure. Each larger sheet may include tens or even hundreds of such partially formed dosage elements on a continuous sheet.

Figure 2:
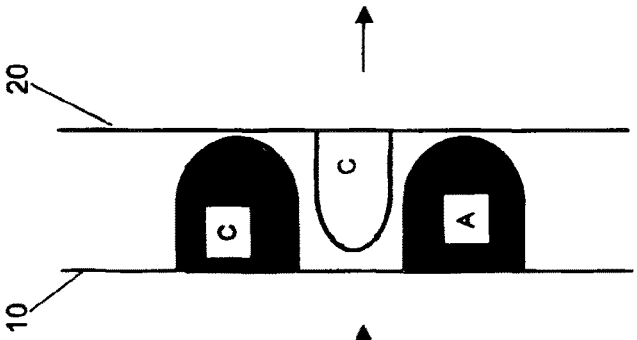
FIG. 2 is a schematic diagram showing the parts of a dosage element as those parts are brought together.

The first and second parts are arranged during the manufacturing process such that substances carried by the first part 10 interdigitate or mesh with substances carried by the second part as the two parts are brought together as shown in FIG. 2.

Figure 6:
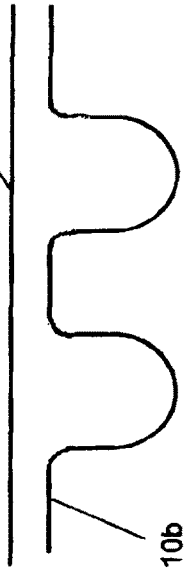
FIG. 6 illustrates a preferred formation for the first/second parts.

Referring now to FIG. 6 briefly, a specific formation of the first part 10 will now be described.

The first part 10 as shown comprises first and second elements 10*a* and 10*b* respectively that are combined to give the formation shown in FIGS. 1 and 2. The first element 10*a* as shown in FIG. 6, comprises a sheet like substrate forming a lid, whilst the second element 10*b* comprises thermoformed elements that form, in the case of first part, two compartments 30, 50. The second element 10*b* may be made by sucking a sheet of thermoformable material into an appropriate mould so as to form the open compartments as illustrated in FIG. 6. Following the formation of the compartments 30, 50, the substances A, C may then be injected into the open compartments.

The reader will realise that whilst the figure is discussed in relation to the construction of the first part 10, the construction of the second part 20 is identical in all respects other than in the number/location of substance compartments.

The finished intermediate products formed by the first part 10 and the second part 20 are each formed by capping and sealing the respective first elements to serve as lids over the top of the respective second elements, to close the compartments 30, 40, 50.

In each case, the intermediate products formed by the first and second parts 10, 20 may then be lifted from the mould, or the mould dropped away from it, whichever is desired.

Figure 5:
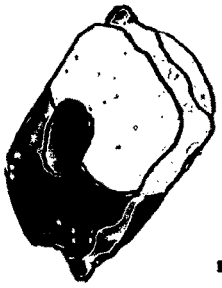
FIG. 5 is a perspective view of a dosage element formed in accordance with an embodiment of the inventive method.
Figure 4:
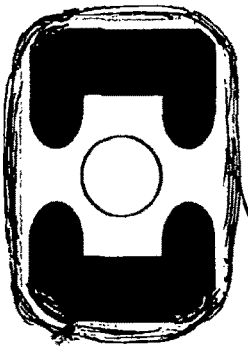
FIG. 4 is a schematic top view of a dosage element in a consolidated state.
Figure 3:
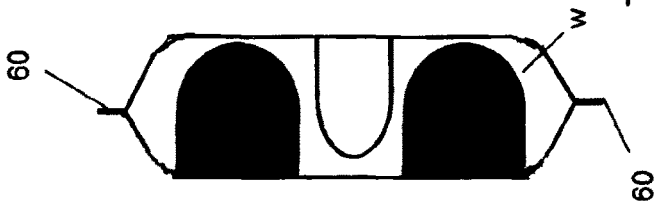
FIG. 3 is a schematic side view showing the first and second parts of the dosage element being sealed together.

Referring back now to FIG. 2, the first and second parts 10, 20 are brought together and, in a consolidating step shown in FIG. 3 are sealed one to another face-to-face around their entire periphery by any convenient process, such as heat sealing/crimping, to provide a single completed article having the formation as shown in FIGS. 4 and 5.

The dosage element formed from the first and second parts is in the shape of a pillow. It is pleasant and feels "squashy" or compliant, rather than "rigid" or box-like. It is shape stable, in the sense that although it can be pressed and manipulated it does not lose its pillow shape. Although in isolation the parts 10, 20 are flexible (in the manner defined earlier) they come together to support each other, and the resulting dosage product is surprisingly robust.

As a consequence of the relatively high stability given by the combination of first and second parts 10, 20 joints between these parts, and weak spots such as curves and corners, are not likely to be damaged by stress.

During the consolidating operation—in which the first and second parts 10, 20 are brought together—and the compartments mesh to give interdigitation of the compartments—the spaces between the side by side compartments 40, 50, 60 collapse to provide a very compact finished product. The thereby closely fitting water soluble skin provided by first part 10 not only blocks bending of the second part 20, but also provides support to potential weak spots such as that illustrated as "w" in FIG. 3.

Whilst the method of forming a dosage element has been described in relation to a single tablet, it will be appreciated that a large plurality of such tablets are manufactured in one forming operation.

The preferred process, in detail, for forming dosage elements is as described below.

The present example provides a process for preparing a water-soluble article comprising a water-soluble thermoformed component, which comprises:—

(A) Forming a first primary component (bottom film) comprising second element 10*b* of the first part 10 into a pocket, by thermoforming in the cavity of a thermoforming primary mould. A suitable forming temperature for PVOH is, for example, 120° C. The thickness of the film used to produce the pocket is preferably 90 to 120 μm. A suitable forming vacuum is 0 to 2 kPa. The primary mould geometry is designed such that it allows for the possibility of combining the compartments of the first part 10 with the compartments of the second part 20.

(B) Introducing the respective substances A, C into the chambers 30, 50 formed by the second element 10*b* into the pocket of the primary mould; and (C) Adding the first element 10*a* as a lid (top film) over the second element when the latter is still in the primary mould to cover the open and filled compartments 30, 50. Here, the thickness of the covering film is generally 60 to 75 μm.

(D) Sealing the first element 10*a* to the second element 10*b* components of the primary mould together. The films of the first and second elements 10*a*, 10*b* may be sealed together by means of an aqueous solution of PVOH, acting as an adhesive. Alternatively they may be sealed together by any other suitable means, for example by means of a further adhesive or by heat sealing. Other methods of sealing include infra-red, radio frequency, ultrasonic, laser, solvent (such as water), vibration and spin welding. If heat sealing is used, a suitable sealing temperature is for example 125° C. A suitable sealing pressure is readily selected by the person skilled in the art.

(E) Forming the second element 20, as just described for the first element 10. The secondary mould geometry is designed to allow the compartments 10, 20 to be combined, in the interdigitated manner already described.

(F) Indexing and fixing the first and second parts 10, 20 together by interdigitation, in order to form a single pocket. The matrix of the first or second parts, preferably having been ejected from their mould, may be applied to the matrix of the other parts, which may still be in their mould. Separation of dosage elements (e.g. by cutting) may occur with the latter parts still in-mould, or following removal of both matrices of parts from their moulds.

The parts may be sealed together by any suitable means, for example by any of the means described about for joining parts 10*a* and 10*b*.

Separation of the dosage elements, wherever undertaken, may be into individual dosage elements or may be into groups of dosage elements, for example 4-16 in number, which are packaged in such groups and are intended to be separated into individual dosage elements by the user.

It will further be understood by the skilled man that the first and second part 10, 20, whilst described as being formed from separate sheets 10*a*, 10*b*, or 20*a*, 20*b* respectively could instead be formed from a single substrate onto which individual elements comprising materials A, B, C are directly or indirectly adhered.

Whether a single substrate is used, or a combination of sheets as described earlier are used, the preferred thickness of carrier (substrate or first element 10*a*, 20*a*) may be within the range of 20-30 μm where the substances A, B, C comprise a combination of powders, or may be up to around 60 μm where A, B or C comprise a gel. This compares favourably with other products which typically require thicker materials of between 300 and 800 μm to ensure a relatively robust end product.

Suitable chemical compositions are as follows. In these examples A and C denote compositions in compartments in the first part and B denotes a composition in a compartment in the second part (see FIG. 1).

EXAMPLE 1

Phosphate-containing composition having percarbonate in a separate compartment (Table 1 below) for use in an automatic dishwasher.

TABLE 1

| Raw Material | A - Powder (8.4 g) | C - Gel (6.4 g) | B - Percarb. (1.3 g) | Walls - PVOH (0.5 g) |
|---|---|---|---|---|
| Sodium tripolyphosphate | 42.50 | | | |
| Sodium carbonate | 16.00 | | | |
| Tri-sodium citrate | 22.00 | | | |
| Phosphate speckles | 4.00 | | | |
| Benzotriazol | 0.40 | | | |
| HEDP 4 Na (88.5%) | 0.30 | | | |
| Protease[1] | 1.50 | | | |
| Amylase[1] | 1.00 | | | |
| TAED | 6.20 | | | |
| 1,2-Propylenediglycol | 0.98 | | | |
| Dye | 0.02 | | | |
| Perfume | 0.10 | | | |
| Sulfonated polymer[2] | 5.00 | | | |
| Sulfonated polymer[2] | | 5.00 | | |
| Surfactant[3] | | 24.00 | | |
| Polyglycol[4] | | 9.00 | | |
| 1,2-Propylendiglycol | | 1.00 | | |
| Dye | | 0.03 | | |
| Antifoam[5] | | 0.25 | | |
| TAED | | 3.00 | | |
| Sodium tripolyphoshate | | 57.42 | | |
| Polyglycol 6000 | | 0.30 | | |
| Sodium percarbonate | | | 100 | |
| PVOH (substrate, pockets)[7] | | | | 60 |
| PVOH (lids)[8] | 100 | | | 40 |
| | 100 | 100 | 100 | 100 |

EXAMPLE 2

Phosphate-containing composition having PAP (phthalimidohexanoic acid) (Table 2 below) in a separate compartment for use in an automatic dishwasher.

TABLE 2

| Raw Material | A - Powder (8.4 g) | C - Gel (6.4 g) | B - PAP (1.3 g) | Walls - PVOH (0.5 g) |
|---|---|---|---|---|
| Sodium tripolyphosphate | 48.70 | | | |
| Sodium carbonate | 16.00 | | | |
| Tri-sodium citrate | 22.00 | | | |
| Phosphate speckles | 4.00 | | | |
| Benzotriazol | 0.40 | | | |
| HEDP 4 Na (88.5%) | 0.30 | | | |
| Protease[1] | 1.50 | | | |

TABLE 2-continued

| Raw Material | A - Powder (8.4 g) | C - Gel (6.4 g) | B - PAP (1.3 g) | Walls - PVOH (0.5 g) |
|---|---|---|---|---|
| Amylase[1] | 1.00 | | | |
| 1,2-Propylenediglycol | 0.98 | | | |
| Dye | 0.02 | | | |
| Perfume | 0.10 | | | |
| Sulfonated polymer[2] | 5.00 | | | |
| Sulfonated polymer[2] | | 5.00 | | |
| Surfactant[3] | | 24.00 | | |
| Polyglycol[4] | | 9.00 | | |
| 1,2-Propylendiglycol | | 1.00 | | |
| Dye | | 0.03 | | |
| Antifoam[5] | | 0.25 | | |
| Sodium tripolyphoshate | | 60.42 | | |
| Polyglycol 6000 | | 0.30 | | |
| PAP[6] | | | 100 | |
| PVOH (substrate, pockets)[7] | | | | 60 |
| PVOH (lids)[8] | | | | 40 |
| | 100 | 100 | 100 | 100 |

EXAMPLE 3

Sodium citrate-containing composition having percarbonate in a separate compartment (Table 3 below) for use in an automatic dishwasher.

TABLE 3

| Raw Material | A - Powder (7.0 g) | C - Gel (6.4 g) | B - Percarb. (2.3 g) | Walls - PVOH (0.4 g) |
|---|---|---|---|---|
| Sodium carbonate | 16.00 | | | |
| Tri-sodium citrate | 68.50 | | | |
| Benzotriazol | 0.40 | | | |
| HEDP 4 Na (88.5%) | 0.30 | | | |
| Protease[1] | 1.50 | | | |
| Amylase[1] | 1.00 | | | |
| TAED | 6.20 | | | |
| 1,2-Propylenediglycol | 0.98 | | | |
| Dye | 0.02 | | | |
| Perfume | 0.10 | | | |
| Sulfonated polymer[2] | 5.00 | | | |
| Sulfonated polymer[2] | | 5.00 | | |
| Surfactant[3] | | 24.00 | | |
| Polyglycol[4] | | 9.00 | | |
| 1,2-Propylendiglycol | | 1.00 | | |
| Dye | | 0.03 | | |
| Antifoam[5] | | 0.25 | | |
| TAED | | 3.00 | | |
| Tri-sodium citrate | | 56.72 | | |
| Polyglycol 35000 | | 1.00 | | |
| Sodium percarbonate | | | 100 | |
| PVOH (substrate, pockets)[7] | | | | 60 |
| PVOH (lids)[8] | | | | 40 |
| | 100 | 100 | 100 | 100 |

EXAMPLE 4

Sodium citrate-containing composition having PAP in a separate compartment (Table 4 below) for use in an automatic dishwasher.

TABLE 4

| Raw Material | A - Powder (7.0 g) | C - Gel (6.4 g) | B - PAP (1.3 g) | Walls - PVOH (0.5 g) |
|---|---|---|---|---|
| Sodium carbonate | 16.00 | | | |
| Tri-sodium citrate | 74.70 | | | |
| Benzotriazol | 0.40 | | | |
| HEDP 4 Na (88.5%) | 0.30 | | | |
| Protease[1] | 1.50 | | | |
| Amylase[1] | 1.00 | | | |
| 1,2-Propylenediglycol | 0.98 | | | |
| Dye | 0.02 | | | |
| Perfume | 0.10 | | | |
| Sulfonated polymer[2] | 5.00 | | | |
| Sulfonated polymer[2] | | 5.00 | | |
| Surfactant[3] | | 24.00 | | |
| Polyglycol[4] | | 9.00 | | |
| 1,2-Propylendiglycol | | 1.00 | | |
| Dye | | 0.03 | | |
| Antifoam[5] | | 0.25 | | |
| Tri-sodium citrate | | 59.72 | | |
| Polyglycol 35000 | | 1.00 | | |
| PAP[6] | | | 100 | |
| PVOH (substrate, pockets)[7] | | | | 60 |
| PVOH (lids)[8] | | | | 40 |
| | 100 | 100 | 100 | 100 |

EXAMPLE 5

MGDA-containing composition having PAP in a separate compartment (Table 5 below) for use in an automatic dishwasher.

TABLE 5

| Raw Material | A - Powder (6.0 g) | C - Gel (6.4 g) | B - PAP (1.3 g) | Walls - PVOH (0.5 g) |
|---|---|---|---|---|
| Sodium carbonate | 16.00 | | | |
| MGDA granules[9] | 74.70 | | | |
| Benzotriazol | 0.40 | | | |
| HEDP 4 Na (88.5%) | 0.30 | | | |
| Protease[1] | 1.50 | | | |
| Amylase[1] | 1.00 | | | |
| 1,2-Propylenediglycol | 0.98 | | | |
| Dye | 0.02 | | | |
| Perfume | 0.10 | | | |
| Sulfonated polymer[2] | 5.00 | | | |
| Sulfonated polymer[2] | | 5.00 | | |
| Surfactant[3] | | 24.00 | | |
| Polyglycol[4] | | 9.00 | | |
| 1,2-Propylendiglycol | | 1.00 | | |
| Dye | | 0.03 | | |
| Antifoam[5] | | 0.25 | | |
| MGDA granules[9] | | 60.22 | | |
| Polyglycol 6000 | | 0.50 | | |
| PAP[6] | | | 100 | |
| PVOH (substrate, pockets)[7] | | | | 60 |
| PVOH (lids)[8] | | | | 40 |
| | 100 | 100 | 100 | 100 |

EXAMPLE 6

Sodium citrate-containing composition having PAP in a separate compartment (Table 6 below) for use in an automatic dishwasher.

TABLE 6

| Raw Material | A - Powder (7.0 g) | C - Powder (7.0 g) | B - PAP (1.3 g) | Walls - PVOH (0.5 g) |
|---|---|---|---|---|
| Sodium carbonate | 17.00 | 17.50 | | |
| Tri-sodium citrate | 68.50 | 68.50 | | |
| Benzotriazol | 0.40 | 0.40 | | |
| HEDP 4 Na (88.5%) | 0.30 | 0.30 | | |
| Protease[1] | 1.50 | | | |
| Amylase[1] | | 1.00 | | |
| TAED | 6.20 | 6.20 | | |
| 1,2-Propylenediglycol | 0.98 | 0.98 | | |
| Dye | 0.02 | 0.02 | | |
| Perfume | 0.10 | 0.10 | | |
| Sulfonated polymer[2] | 5.00 | 5.00 | | |
| Sodium percarbonate | | | 100 | |
| PVOH (substrate, pockets)[7] | | | | 60 |
| PVOH (lids)[8] | | | | 40 |
| | 100 | 100 | 100 | 100 |

The container used in this example has 3 compartments separated from each other. In one compartment the PAP composition or the percarbonate composition is filled, respectively.

The powder is introduced into the powder compartment. The gel mixture is heated to 65° C. and stirred for 20 min. Then the gel is introduced into the gel compartment and is allowed to cool. Finally the compartments are sealed with PVOH film.

In the example the particle size of the PAP has preferably a size of 0.01-100 μm (Q50%<15 μm).

In all examples above illustrating the present invention the dosage element is consumed in a washing cycle, in the sense that at the end of cycle no part of it has to be removed from the machine; indeed no part of it can be discerned, within the machine.

Whilst three substances are discussed, the skilled man will realise that, according to a particular function to be performed, more or fewer substances may be utilised and combined in any logical combination without departing from the principles of the present invention.

The dosage element as described above provides a very convenient and compact arrangement that is easy to manufacture, and subsequently which is resistant to bending and other stress.

The invention claimed is:

1. A laundry or machine dishwashing dosage element, the laundry or machine dishwashing dosage element comprising first and second joined parts, wherein the first part comprises a water-soluble polymeric film substrate carrying one or more solid laundry or machine dishwashing substances, wherein the second part comprises a water-soluble polymeric film substrate carrying one or more further solid laundry or machine dishwashing substances, wherein the first part is joined to the second part in peripheral areas thereof so as to form a closed receptacle enclosing said solid laundry or machine dishwashing substances within it and so as to form at least one collapsed space between the solid laundry or machine dishwashing substances, and wherein the water-soluble polymeric film substrate of the first part comprises a plurality of mutually separated solid laundry or machine dishwashing substances arranged in side by side relation such that the plurality of substances carried by the first water-soluble polymeric film substrate and the further solid laundry or machine dishwashing substance or substances carried by the second water-soluble polymeric film substrate mesh or interdigitate within the receptacle.

2. The dosage element of claim 1, wherein each of the first and second parts comprises respective first and second elements, wherein each second element comprises a pocket having one or more compartments for receiving at least one of the solid laundry or machine dishwashing substance therein and wherein each first element closes the pocket formed by the respective second element such that each solid laundry or machine dishwashing substance is enclosed within a respective compartment.

3. The dosage element of claim 1, wherein the first part and the second part are flexible in isolation, but when joined to one another the dosage element formed is shape-stable.

4. The dosage element of claim 1, wherein the water-soluble polymeric film substrate of the first part has a thickness of 60 to 75 μm and the water-soluble polymeric film substrate of the second part has a thickness of 90 to 120 μm.

5. A method of manufacturing a laundry or machine dishwashing dosage element, the method comprising:

(a) forming a first part into a substrate comprising a water-soluble polymeric film carrying one or more solid laundry or machine dishwashing substances;

(b) forming a second part into a substrate comprising a water-soluble polymeric film carrying one or more further solid laundry or machine dishwashing substances;

wherein at least one of the substrate of the first part and the substrate of the second part carries more than one of the solid laundry or machine dishwashing substances and has at least one space between the solid laundry or machine dishwashing substances; and (c) joining the first part to the second part in peripheral areas thereof so as to form a closed receptacle enclosing the solid laundry or machine dishwashing substances within it and so as to collapse the at least one space between said substances.

6. The method of claim 5, wherein in step (c) the first and second parts are arranged such that the first substrate carries a plurality of solid laundry or machine dishwashing substances and the solid laundry or machine dishwashing substances carried by the first and second substrates mesh or interdigitate.

7. The method of claim 5, wherein steps (a) and (b) each comprises the sub-steps of:

(a1, b1) forming a pocket with one or more chambers;

(a2, b2) introducing the solid laundry or machine dishwashing substances to the one or more chambers of the pocket; and (a3, b3) sealing the chambers with a lid.

8. The method of claim 7, wherein steps (a1, b1) each comprise thermoforming a film of the water-soluble polymeric substance within a cavity of one or more moulds, and steps (a3, b3) comprise sealing the respective lids to the substrates in the moulds in which they were formed.

9. A dosage element manufactured by the method of claim 5.

10. A method of dishwashing or laundry machine washing, comprising the steps of:

providing a dosage element according to claim 1 to a dishwashing or laundry washing machine;

providing wares to be washed within the dishwashing or laundry washing machine;

operating the dishwashing or laundry washing machine to wash the wares.

* * * * *